US007891662B2

(12) United States Patent
Nagai

(10) Patent No.: US 7,891,662 B2
(45) Date of Patent: Feb. 22, 2011

(54) INFORMATION WRITING APPARATUS AND INFORMATION WRITING METHOD

(75) Inventor: Takeharu Nagai, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 357 days.

(21) Appl. No.: 12/104,889

(22) Filed: Apr. 17, 2008

(65) Prior Publication Data

US 2009/0085273 A1 Apr. 2, 2009

(30) Foreign Application Priority Data

Sep. 28, 2007 (JP) ..... 2007-254763

(51) Int. Cl.
*B65H 5/00* (2006.01)

(52) U.S. Cl. ..... 271/264

(58) Field of Classification Search ..... 271/264
See application file for complete search history.

(56) References Cited

FOREIGN PATENT DOCUMENTS

| | | | |
|---|---|---|---|
| JP | 59-61145 | U | 4/1984 |
| JP | 05-043079 | A | 2/1993 |
| JP | 08-077309 | A | 3/1996 |
| JP | 11-011727 | A | 1/1999 |
| JP | 2003-140548 | A | 5/2003 |
| JP | 2004-107020 | A | 4/2004 |
| JP | 2006-139582 | A | 6/2006 |

OTHER PUBLICATIONS

Japanese Office Action for JP Appln. No. 2007-254763 dated Dec. 22, 2009 and English translation.

*Primary Examiner*—David H Bollinger
(74) *Attorney, Agent, or Firm*—Sughrue Mion, PLLC

(57) ABSTRACT

An information writing apparatus includes: a transport unit that transports a sheet having a wireless IC element; and a transmitting and receiving unit that transmits and receives signals to/from the wireless IC element in a sheet transported by the transport unit, the transport unit including a first belt made of nonmetal and a second belt made of nonmetal placed facing and contacting the first belt, the sheet being transported, caught between the first belt and the second belt.

17 Claims, 14 Drawing Sheets

INFORMATION WRITING APPARATUS AND INFORMATION WRITING METHOD

CROSS-REFERENCE TO RELATED APPLICATIONS

This application is based on and claims priority under 35 USC 119 from Japanese Patent Application No. 2007-254763 filed Sep. 28, 2007.

BACKGROUND

1. Technical Field

The present invention relates to an information writing apparatus and an information writing method.

2. Related Art

Lately, wireless integrated circuit (IC) elements, e.g., RFID (Radio Frequency Identification) tags have been used in a variety of fields.

SUMMARY

According to an aspect of the invention, there is provided an information writing apparatus including: a transport unit that transports a sheet having a wireless IC element; and a transmitting and receiving unit that transmits and receives signals to/from the wireless IC element in a sheet transported by the transport unit, the transport unit including a first belt made of nonmetal and a second belt made of nonmetal placed facing and contacting the first belt, the sheet being transported, caught between the first belt and the second belt.

BRIEF DESCRIPTION OF THE DRAWINGS

Exemplary embodiments of the present invention will be described in detail based on the following figures, wherein:

FIGS. 9A and 9B depict a fourth exemplary embodiment of the invention, wherein FIG. 9A is a plan view of the information writing apparatus main body and FIG. 9B is a rear view thereof;

FIGS. 11A and 11B are side view depicting a belt device in a sixth exemplary embodiment of the invention, wherein FIG. 11A illustrates a state where the first take-in supporting roller and the first take-out supporting roller are in an upper position and FIG. 11B illustrates a state where the first take-in supporting roller and the first take-out supporting roller are in a lower position;

FIGS. 12A and 12B are side views depicting a belt device in a seventh exemplary embodiment of the invention, wherein FIG. 12A illustrates a state where the length of the section in which the first belt contacts the second belt is long and FIG. 12B illustrates a state where the length of the section in which the first belt contacts the second belt is short;

FIGS. 15A and 15B are plan views depicting an information writing apparatus main body in the eighth exemplary embodiment of the invention, wherein FIG. 15A illustrates a state before the main body takes in a paper sheet and FIG. 15B illustrates a state during the transport of a paper sheet; and FIGS. 16A and 16B depict a belt device in a ninth exemplary embodiment of the invention, wherein FIG. 16A is a front view and FIG. 16B is a perspective view.

DETAILED DESCRIPTION

Figure 1:
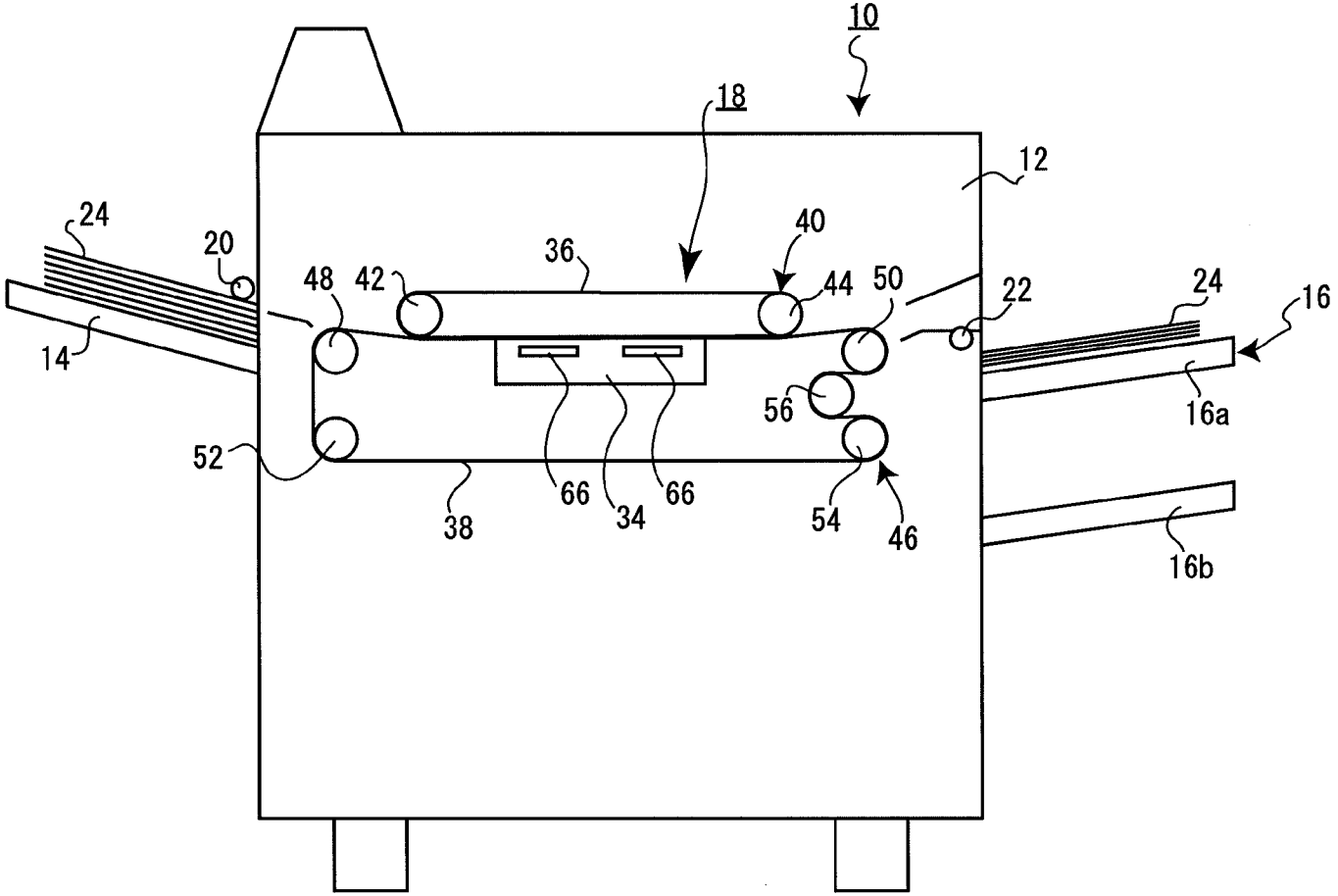
FIG. 1 is a side view depicting an information writing apparatus in accordance with a first exemplary embodiment of the invention.
Figure 2:
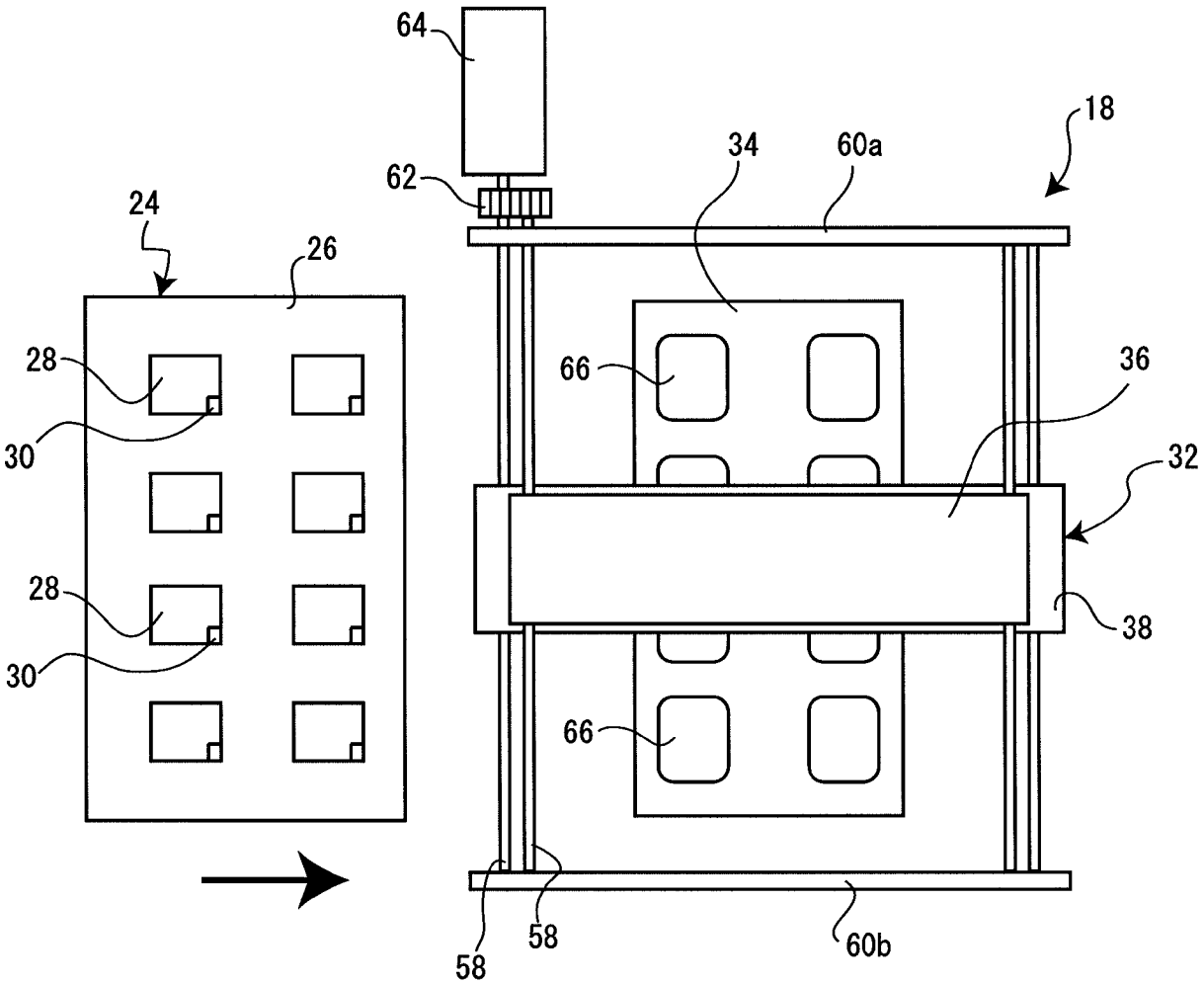
FIG. 2 is a plan view depicting a paper sheet and the information writing apparatus main body in the first exemplary embodiment of the invention.

In the following, exemplary embodiments of the present invention will be described in detail with reference to the drawings. FIG. 1 is a side view depicting an information writing apparatus 10 in accordance with one exemplary embodiment of the invention. FIG. 2 is a plan view depicting the information writing apparatus 10 and a paper sheet 24 to which information should be written.

The information writing apparatus 10 has a chassis 12. A paper supply 14 is provided on one side of the chassis 12 and a paper collector 16 is provided on the other side thereof. Inside the chassis 12, an information writing apparatus main body 18 which will be described later is placed. A number of sheets of paper 24 are stacked on the paper supply 14. After separated sheet by sheet, a paper sheet on the paper supply 14 is driven by a feed roller 20 and fed to the information writing apparatus main body 18. A paper sheet 24 to which information has been written by the information writing apparatus main body 18 is ejected by a eject roller 22 to the paper collector 16. The paper collector 16 includes, for example, two stages of collection trays 16*a*, 16*b* and a paper sheet 24 is selectively ejected to one of the collection trays 16*a*, 16*b*.

A paper sheet 24 is, for example, a sheet of label paper of A4 size. On the paper body 26, labels 28 which can be peeled off are arranged, regularly spaced at certain intervals; four ones in a longitudinal direction and two ones in a lateral direction. Each label 28 has a printed bar code or the like and includes a wireless IC element 30 which is, for example, an RFID tag. The wireless IC element 30 is capable of wireless communication within a short range (from several centimeters to several meters) via an electromagnetic field, radio waves, or the like, so that information will be read from and written to it. In this exemplary embodiment, one electromagnetic induction type, 13.56 MHz type is used. A paper sheet 24 is fed to the information writing apparatus main body 18, wherein its transport direction is parallel to its lateral direction, as shown in FIG. 2.

The information writing apparatus main body 18 includes a belt device 32 and a reader/writer unit 34.

The belt device 32 has a first belt 36 and a second belt 38 facing and contacting each other in upper and lower positions in the direction of gravitational force. The first belt 36 and the second belt 38 turns in the paper transport direction to transport a paper sheet caught between the belts 36, 38. In this exemplary embodiment, the first belt 36 and the second belt 38 each are formed of a single belt material and have a width smaller than the width of a paper sheet 24 so that a nearly middle portion of the paper sheet 24 is nipped between them. For example, the width of the belts 36, 38 is 50 mm, whereas the width of an A4 paper sheet 24 is 297 mm. So, the remaining portion of the sheet 24 except the band of 50 mm faces directly toward the reader/writer unit 34. Although an A4 sheet of a landscape orientation is transported in this exemplary embodiment, a paper sheet having a width of at least 50 mm can be transported. The first belt 36 and the second belt 38 are made of nonmetal, e.g., resin. Resin that can be used for the belts 36, 38 involves, polypropylene, polyethylene, polyacetal, polyester, poly-e-acetal, heat-resistant nylon, etc.

The first belt 36 is supported by a first group of supporting rollers 40. The first group of supporting rollers 40 includes a first take-in supporting roller 42 placed in the paper take-in side and a first take-out supporting roller 44 placed in the paper take-out side. The second belt 38 is supported by a second group of supporting rollers 46. The second group of supporting rollers 46 includes a second taken-in supporting roller 48 placed in the paper take-in side, a second taken-out supporting roller 50 placed in the paper take-out side, supporting rollers 52, 54 placed beneath the second taken-in supporting roller 48 and the second taken-out supporting roller 50, respectively, and a supporting roller 56 placed between the second taken-out supporting roller 50 and the supporting roller 50. These supporting rollers 42, 44, 48, 50, 52, 54, 56 are fixed to shafts 58. The shafts 58 are rotatably supported by frames 60*a*, 60*b* placed in both sides of the belt device 32 and the rollers rotate around the shafts. The shafts 58 of the first take-in supporting roller 42 and the second take-in supporting roller 48 extend outward beyond one frame 60*a* and connected to a transport motor 64 which delivers a driving force via a gear train 62. By the driving force of the transport motor 64, which is transferred via the gear train 62 and the shafts 58 to the first take-in supporting roller 42 and the second take-in supporting roller 48, these rollers 42 and 48 rotate in opposite directions to each other. This causes the belts 36, 38 to turn in the paper transport direction, so that a paper sheet caught between the belts 36, 38 is transported.

The reader/writer unit 34 is installed in a space surrounded by the second belt 38. Antennas 66 as transmitting and receiving members for transmitting and receiving signals to/from wireless IC elements 30 in a paper sheet 24 are arranged on the top surface of the reader/writer unit 34. The antennas 66 are positioned so as to correspond to the positions of the labels 28 on a paper sheet 24; that is, four ones are arranged in a direction at right angle to the paper transport direction, and two ones in the transport direction, regularly spaced at certain intervals.

The reader/writer unit 34 may optionally be replaced by a reader having only a reading function or a writer having only a writing function.

Figure 3:
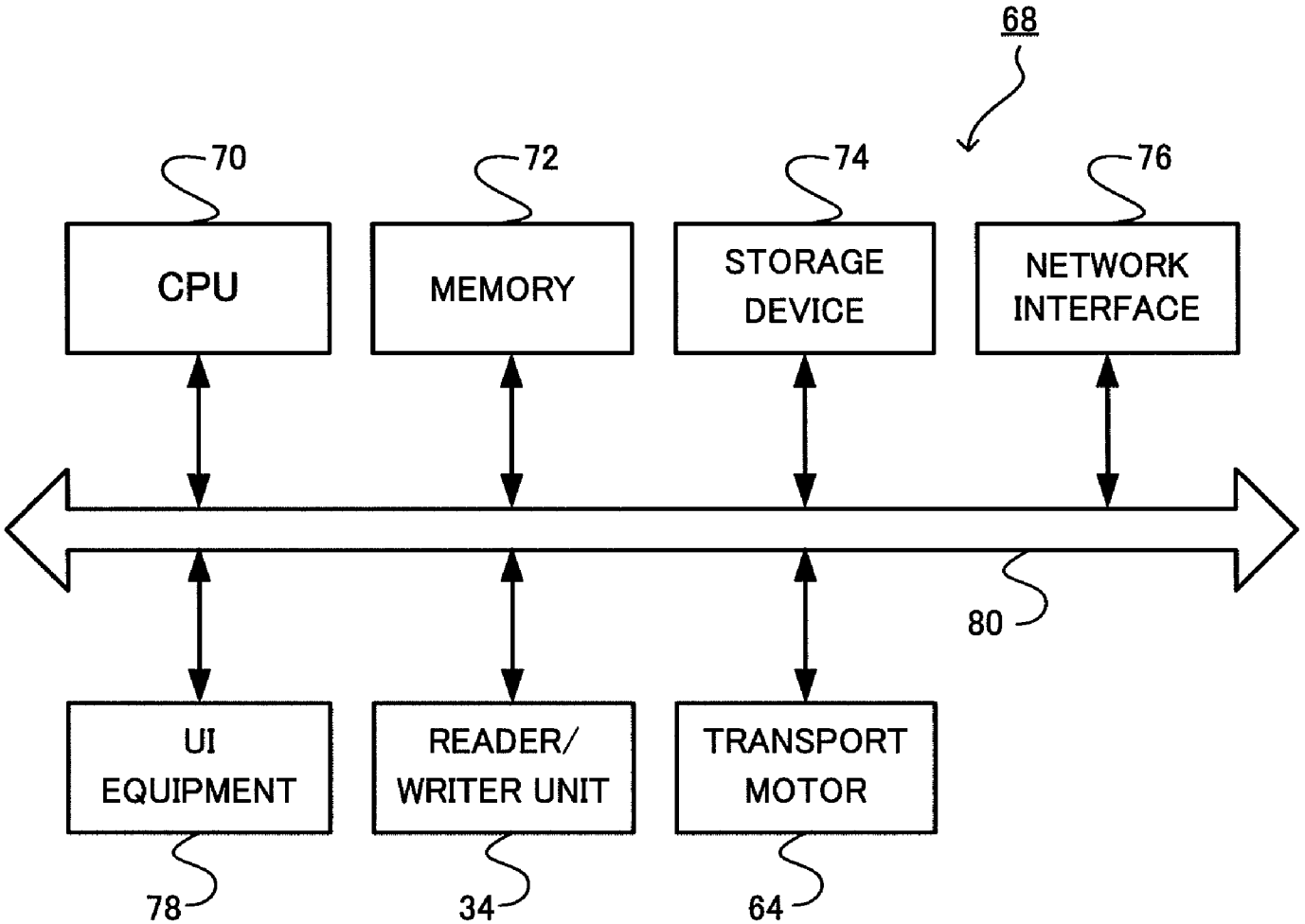
FIG. 3 is a block diagram showing a controller in the first exemplary embodiment of the invention.

FIG. 3 is a block diagram showing a controller 68 for controlling the information writing apparatus 10. The controller 68 includes a CPU 70, a memory 72, a storage device 74 such as a hard disk drive (HDD), a network interface 76 for transmitting and receiving data to/from an external device or the like via a network, user interface (UI) equipment 78 including a touch panel or a liquid crystal display and a keyboard, the reader/writer unit 34, and the transport motor 64, which are interconnected via a control bus 80.

Figure 4:
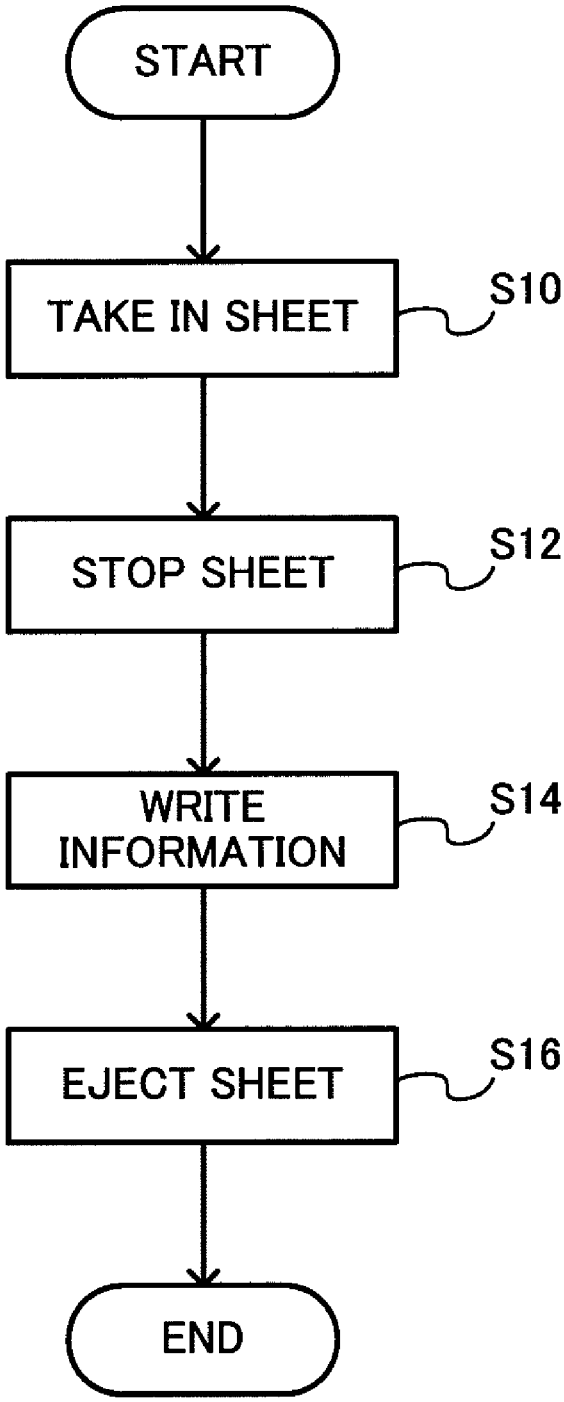
FIG. 4 is a flowchart illustrating operation controlled by the controller in the first exemplary embodiment of the invention.

FIG. 4 is a flowchart illustrating an example of operation controlled by the controller 68.

First, at step S10, the information writing apparatus main body 18 takes in a paper sheet 24 fed from the paper supply tray 14. At the next step S12, upon detecting that the labels 28 on the paper sheet 24 have come in the positions facing the antennas 66 of the reader/writer unit 34, the controller 68 stops the driving of the transport motor 64 to stop the paper sheet 24 in the current position. At the next step S14, the reader/writer unit 34 is controlled so that it reads, e.g., IDs or the like from the wireless IC elements 30 in the paper sheet 24, reads information to be written, already related to the IDs and stored in the storage device 74, transmits the read information via the antennas 66 to the wireless IC elements 30, and writes the information into the wireless IC elements 30. Once the information has been written into all wireless IC elements 30 in the sheet, the procedure goes to the next step S16 where the paper sheet 24 to which the information has been written is ejected to the paper collection tray 16. These steps are repeated until information has been written to all sheets of paper 24 required.

In the above step S12, the controller 68 stops the paper sheet 24 being transported when writing information to it, but it is not always to do so. In another exemplary embodiment, the controller 68 may control the transport speed of the paper sheet 24 so that the sheet is moved at a lower speed than normal when information is written to it, thus assuring a sufficient time to write information into the wireless IC elements 30 in the paper sheet 24.

The above exemplary embodiment is further explained.

Figure 5:
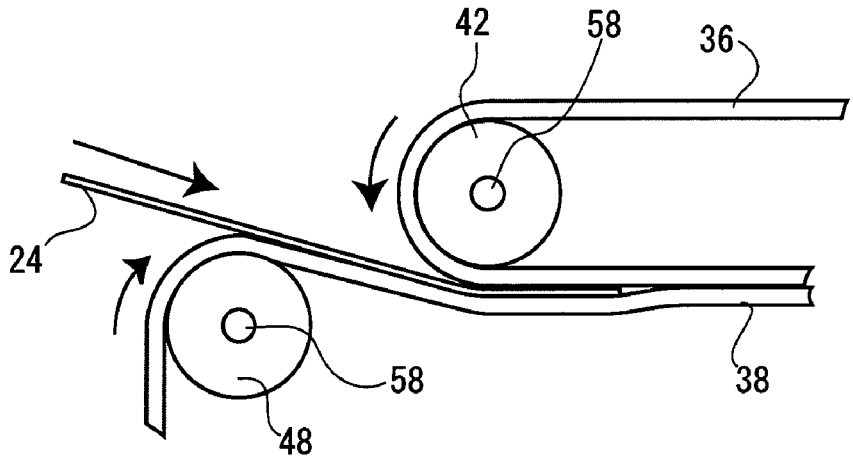
FIG. 5 is a side view depicting a relationship between a first take-in supporting roller and a second take-in supporting roller used in the first exemplary embodiment of the invention.

FIG. 5 is a side view depicting a relationship between the first take-in supporting roller 42 and the second take-in supporting roller 48. The shaft 58 of the first take-in supporting roller 42 and the shaft 58 of the second take-in supporting roller 48 are in different positions in the transport direction of the paper sheet 24. The first take-in supporting roller 42 is placed downstream from the second take-in supporting roller 48 in the transport direction of a paper sheet 24. When viewed from a horizontal perspective, the bottom end of the first take-in supporting roller 42 is offset lower than the top end of the second take-in supporting roller 48, so that the first belt 36 is pressed against the second belt 38 by the first take-in supporting roller 42. Therefore, unlike a configuration where two take-in supporting rollers are vertically aligned in contact with each other, under the pressing force of the first take-in supporting roller 42, a component of the tensile force of the second belt 38 is exerted between the first belt 36 and the second belt 38 to catch the paper sheet 24 nipped therebetween. Thus, the paper sheet 24 being fed from obliquely upward can smoothly be nipped between the belts by a moderate force not to damage wireless IC elements 30.

Figure 6:
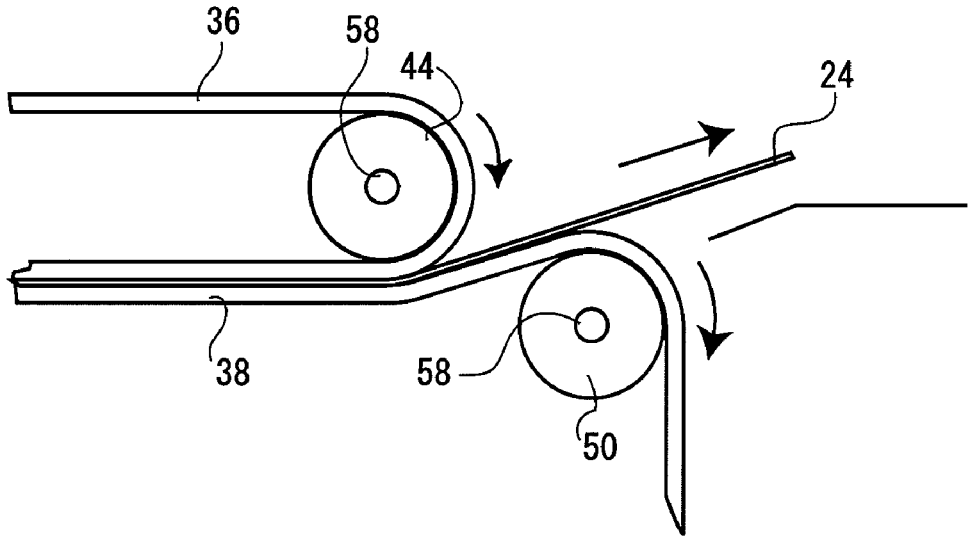
FIG. 6 is a side view depicting a relationship between a first take-out supporting roller and a second take-out supporting roller used in the first exemplary embodiment of the invention.

FIG. 6 is a side view depicting a relationship between the first take-out supporting roller 44 and the second take-out supporting roller 50. The shaft 58 of the first take-out supporting roller 44 and the shaft 58 of the second take-out supporting roller 50 are in different positions in the transport direction of the paper sheet 24. The first take-out supporting roller 44 is placed upstream from the second take-out supporting roller 50 in the transport direction of the paper sheet 24. When viewed from a horizontal perspective, the bottom end of the first take-out supporting roller 44 is offset lower than the top end of the second take-out supporting roller 50, so that the first belt 36 is pressed against the second belt 38 by the first take-out supporting roller 44. Therefore, unlike a configuration where two take-out supporting rollers are vertically aligned in contact with each other, under the pressing force of the first take-out supporting roller 44, a component of the tensile force of the second belt 38 is exerted between the first belt 36 and the second belt 38 to eject a paper sheet 24 nipped therebetween. Thus, the paper sheet 24 can smoothly be ejected by a moderate force not to damage wireless IC elements 30 of the paper sheet 24. In this case, because the paper sheet 24 is biased to go obliquely upward, paper jamming as trapped in an ejection chute or the like can be prevented.

Figure 7:
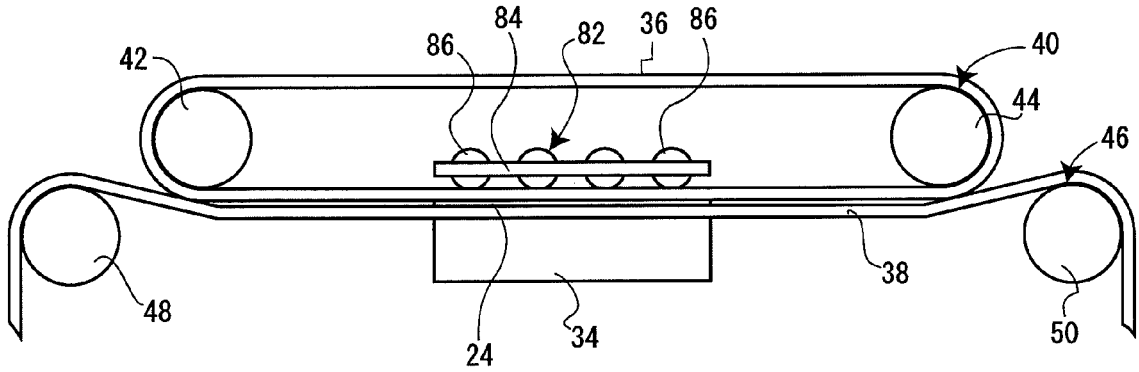
FIG. 7 is a side view depicting an information writing apparatus main body in a second exemplary embodiment of the invention.

FIG. 7 depicts a second exemplary embodiment of the invention.

In the first exemplary embodiment already described, no additional nipping force is exerted between the first belt 36 and the second belt 38 in the section between the first take-in supporting roller 42 and the first take-out supporting roller 44. Consequently, the paper sheet 24 might be misaligned relative to the reader/writer unit 34, when it is stopped in the front of the reader/writer unit 34, because of insufficient force by which the paper sheet 24 remains nipped between the belts. Misalignment of the paper sheet 24 relative to the reader/writer unit 34 results in misalignment of the wireless IC elements 30 in the paper sheet 24 relative to the antennas 66 of the reader/writer unit 34. This might introduce a fault in transmission and reception. In the second exemplary embodiment, therefore, a weight 82 which is a pressing force generating unit that generates a force of pressing the first belt 36 against the second belt 38 is provided between the first take-in supporting roller 42 and the first take-out supporting roller 44. The weight 82 is made up of a supporting member 84 and plural pressing components 86 supported by the supporting member 84. The pressing components 86 are made from rollers and glass balls. The weight 82 is supported movably up and down. The pressing components 86 depress the first belt 36 by gravity and strengthen the force by which a paper sheet 24 is caught between the first belt 36 and the second belt 38, thus preventing the paper sheet 24 from misaligning relative to the reader/writer unit 34.

Figure 8:
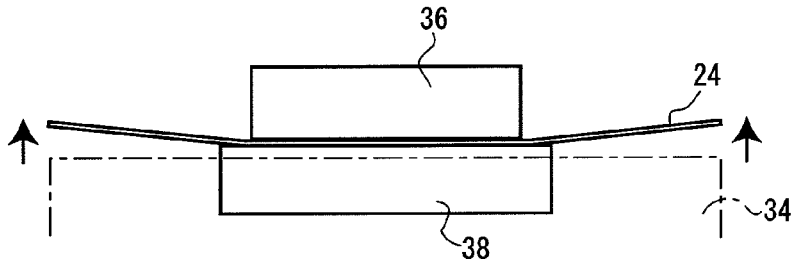
FIG. 8 is a front view depicting first and second belts in a third exemplary embodiment of the invention.

FIG. 8 depicts a third exemplary embodiment of the invention.

In the third exemplary embodiment, the width of the first belt 36 (width in a direction at right angle to the paper transport direction) is set smaller than the width of the second belt 38 (width in a direction at right angle to the paper transport direction). Due to this, the paper sheet 24 guided into the information writing apparatus main body 18 can slightly be bowed upward toward its both ends (both ends of the paper sheet 24 in a direction at right angle to the paper transport direction). There may be screws and recesses on the top surface of the reader/writer unit 34. By making the paper sheet 24 slightly bow upward toward its both edges, paper jamming, as the paper sheet 24 is caught by a screw or a recess, can be prevented.

The width of the first group of supporting rollers 40 for supporting the first belt 36 is also set smaller than the width of the second group of supporting rollers 46 for supporting the second belt 38.

Figure 9A:
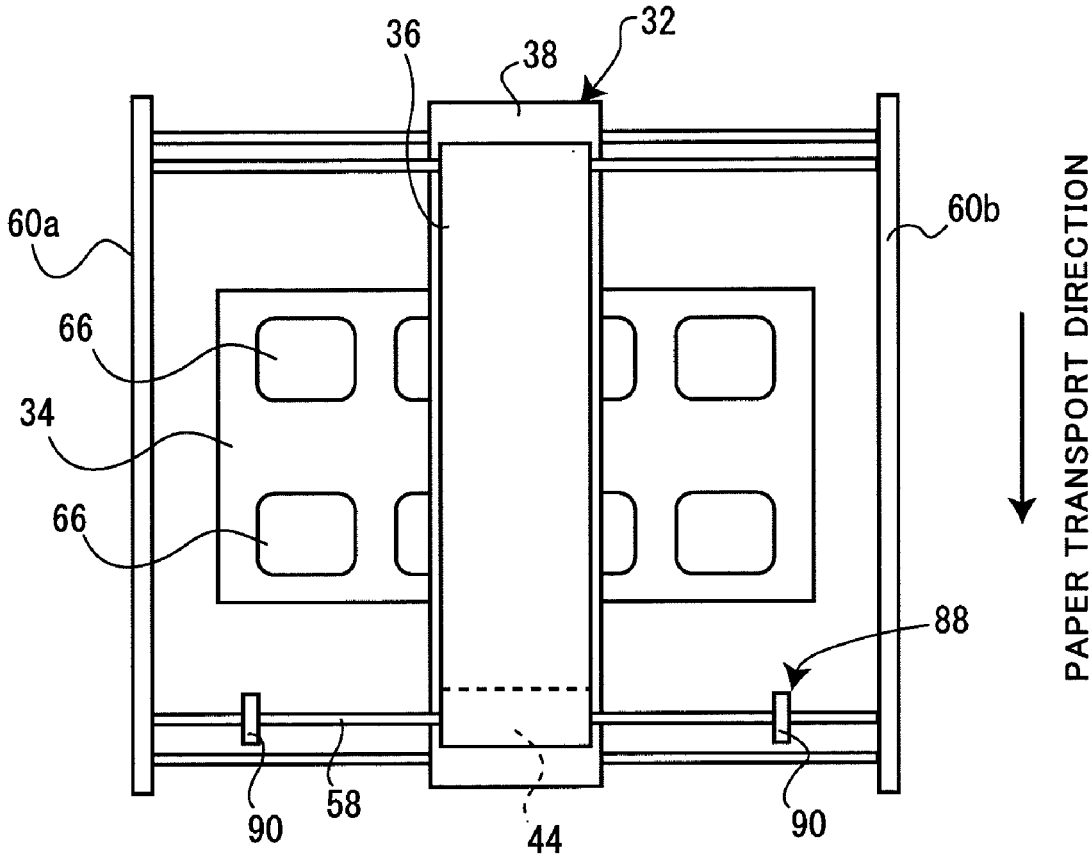
Figure 9B:
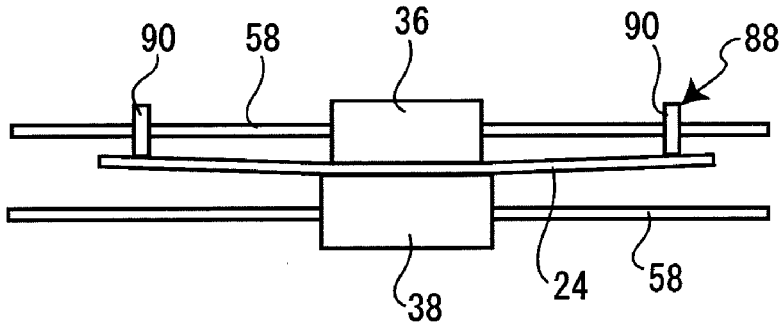

FIGS. 9A and 9B depict a fourth exemplary embodiment of the invention.

In the fourth exemplary embodiment, a paper warp preventing component 88 is provided that prevents the paper sheet 24 from warping in its both edges at the take-out side. The paper warp preventing component 88 is made up of auxiliary rollers 90 fixed to the shaft 58 of the second take-out supporting roller 44. The auxiliary rollers 90 are arranged in the both sides of the second take-out supporting roller 44 and have a diameter that is set equal to the diameter of the second take-out supporting roller 44. These rollers touch the surface of the paper sheet 24 to be ejected in both edges in a direction at right angle to the transport direction and prevent the paper sheet 24 from warping upward in its both edges, thus preventing paper jamming, as the edges of the paper sheet 24 is caught in the ejection chute or the like.

Figure 10:
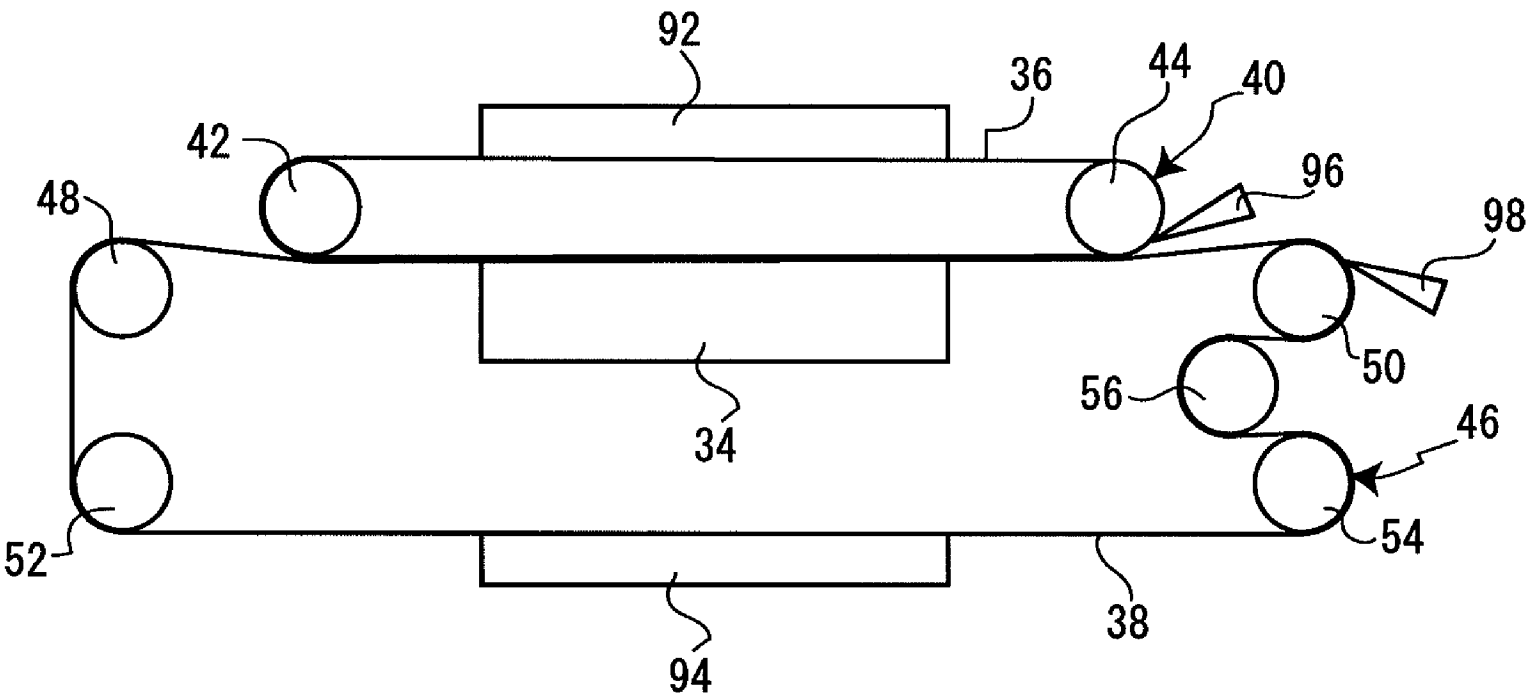
FIG. 10 is a side view depicting an information writing apparatus main body in a fifth exemplary embodiment of the invention.

FIG. 10 depicts a fifth exemplary embodiment of the invention.

In the fifth exemplary embodiment, a first charging member 92 included in a charging unit is provided on the top surface of the first belt 36 and a second charging member 94 also included in the charging unit is provided on the under surface of the second belt 38. The first charging member 92 and the second charging member 94 are made from, e.g., brushes and contact the surfaces of the first belt 36 and the second belt 38. For example, before starting the transport of a paper sheet, the first belt 36 and the second belt 38 are turned a given number of times so that the first belt 36 and the second belt 38 are charged. Consequently, a paper sheet that is transported caught between the first belt 36 and the second belt 38 is held in place with the aid of electrostatic charge causing the sheet to cling to the belts.

In the paper take-out side, a first peel-off member 96 and a second peel-off member 98 are provided to touch the first belt 36 and the second belt 38, respectively. By the first peel-off member 96 and the second peel-off member 98, a paper sheet clung to the first belt 36 and the second belt 38 is peeled off, thus preventing paper jamming.

While the charging members are provided on both the first belt 36 and the second belt 38 in the fifth exemplary embodiment, in another exemplary embodiment, a charging member may only be provided on one belt.

Figure 11A:
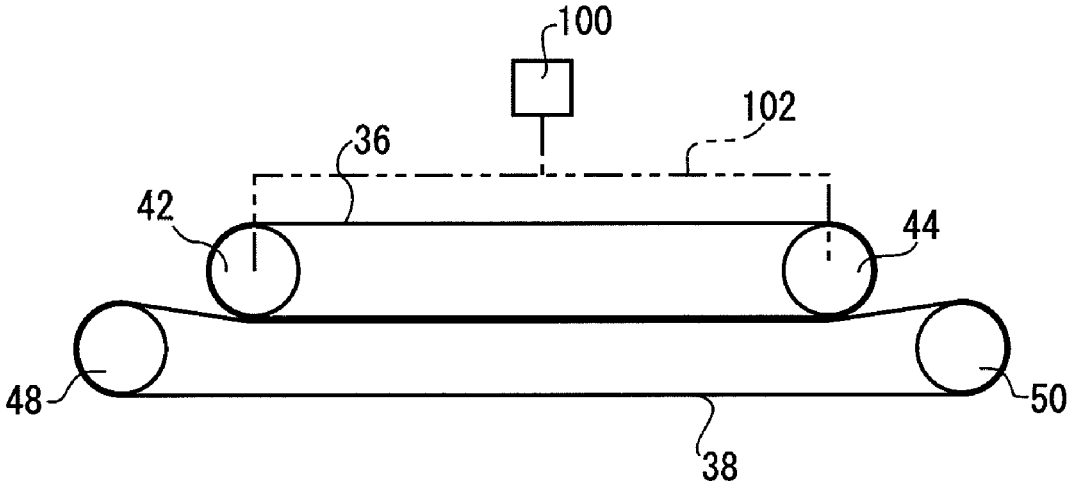
Figure 11B:
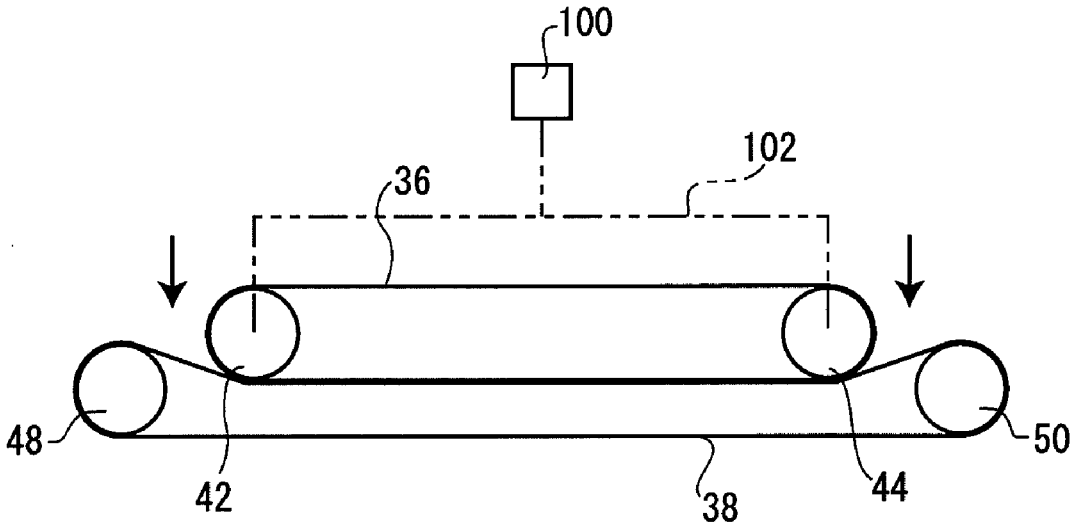

FIGS. 11A and 11B depict a sixth exemplary embodiment of the invention.

In the sixth exemplary embodiment, a first actuator 100 is provided as a pressing force adjusting unit that adjusts the pressing forces of the first take-in supporting roller 42 and the first take-out supporting roller 44 exerted on the second belt 38. That is, the first take-in supporting roller 42 and the first take-out supporting roller 44 are connected via a first linkage mechanism 102 to the actuator 100, so that they move vertically by the driving force of the actuator 100. When the first take-in supporting roller 42 and the first take-out supporting roller 44 move vertically, the pressing forces of the first take-in supporting roller 42 and the first take-out supporting roller 44 exerted on the second belt 38 are adjusted. The first actuator 100 is driven, for example, depending on the thickness of a paper sheet being transported. If a paper sheet being transported is thin, the first take-in supporting roller 42 and the first take-out supporting roller 44 are moved downward, as shown in FIG. 11B, wherein the pressing forces are increased to ensure that a sufficient force is provided to transport the sheet and to maintain the accuracy of stopping the sheet.

In the above sixth exemplary embodiment, the actuator moves both the first take-in supporting roller 42 and the first take-out supporting roller 44, but it is not always to do so. The actuator may move only one of these rollers.

Figure 12A:
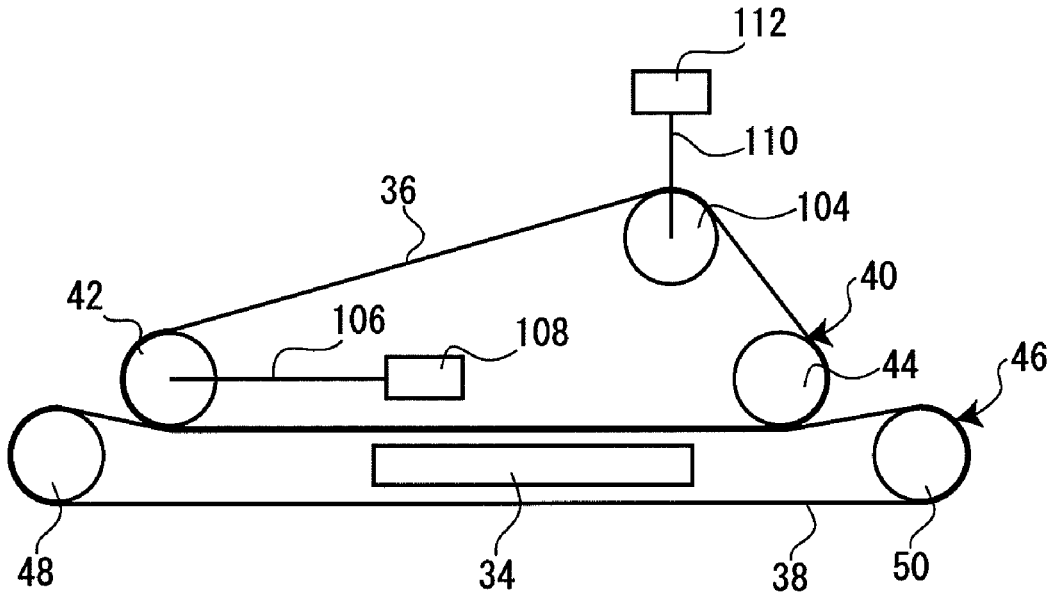
Figure 12B:
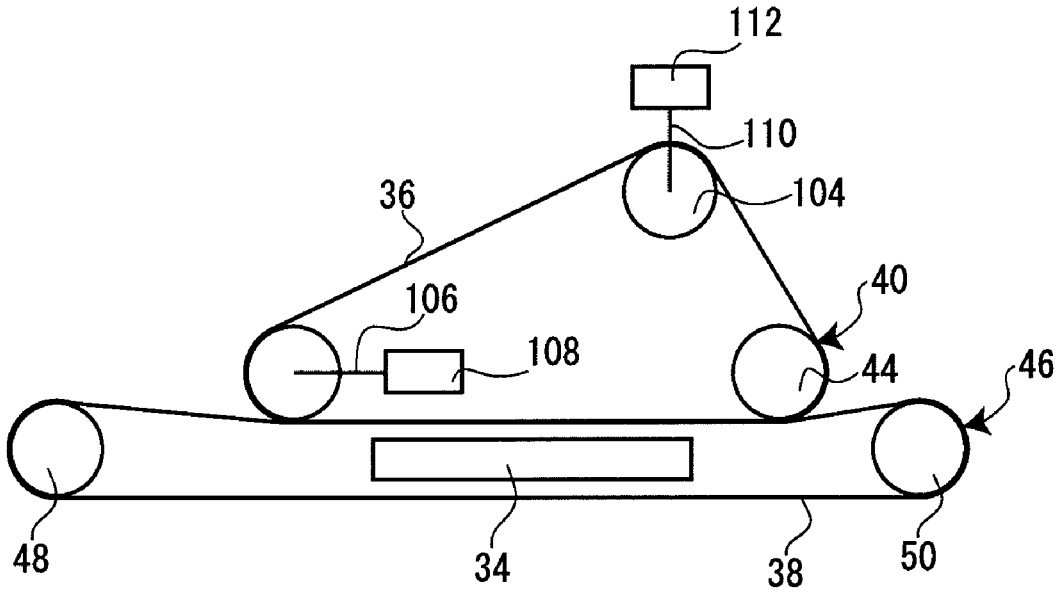

FIGS. 12A and 12B depict a seventh exemplary embodiment of the invention.

In the seventh exemplary embodiment, the first group of supporting rollers includes an intermediate supporting roller 104 besides the first take-in supporting roller 42 and the first take-out supporting roller 44, so that the first belt 36 is supported by three supporting rollers. The first take-in supporting roller 42 is connected to a second actuator 108 via a second linkage mechanism 106. The intermediate supporting roller 104 is connected to a third actuator 112 via a third linkage mechanism 110. The second actuator 108 and the third actuator 112 are driven, for example, depending on the length of a paper sheet in the transport direction. If the length of a paper sheet in the transport direction is short, the first take-in supporting roller 42 is moved downstream in the transport direction and the intermediate supporting roller 104 is moved upward, as shown in FIG. 12B. In this way, the length of the section in which the first belt 36 contacts the second belt 38 is adjusted to become shorter, while keeping the length of the circumference of the first belt 36 unchanged. Even if the length of a paper sheet in the transport direction varies, by adjusting the length of the section in which the first belt 36 contacts the second belt 38, the force by which a paper sheet is caught between the first belt 36 and the second belt 38 is kept at a given level or more. In this way, it is ensured that a sufficient force is provided to transport the sheet and the accuracy of stopping the sheet is maintained.

Figure 13:
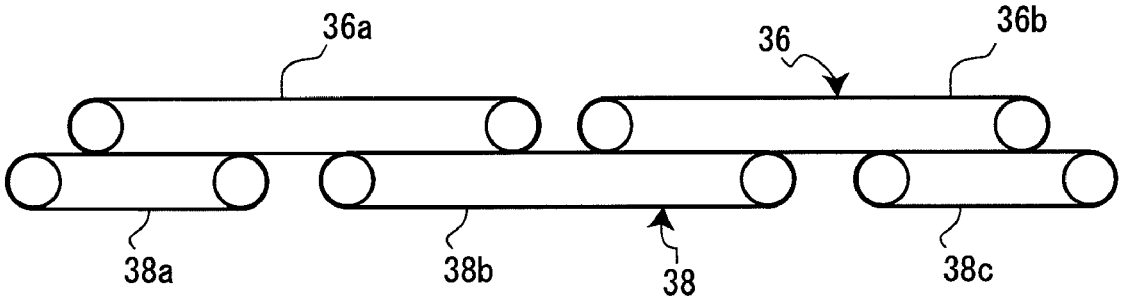
FIG. 13 is a side view depicting a belt device in an eighth exemplary embodiment of the invention.

FIG. 13 depicts an eighth exemplary embodiment of the invention.

In the eighth exemplary embodiment, the first belt 36 is divided into plural belts 36*a*, 36*b* and the second belt 38 is divided into plural belts 38*a*, 38*b*, 38*c*. In this case also, the supporting rollers that support each belt are placed in different positions in the paper transport direction. The eighth exemplary embodiment is applicable for a solution in the following case: the length of a paper sheet in the transport direction is long; the force for transporting a paper sheet is insufficient; or the accuracy of stopping a paper sheet is insufficient.

Figure 14:
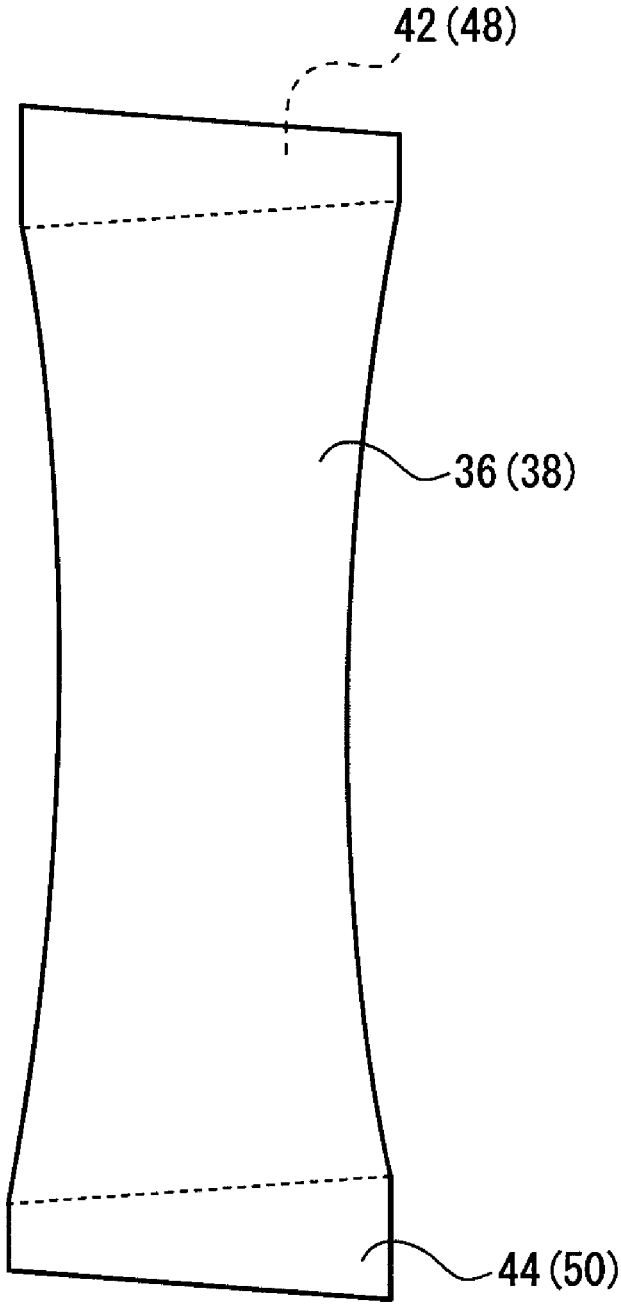
FIG. 14 is a plan view depicting the belt device in the eighth exemplary embodiment of the invention.

FIG. 14 depicts a ninth exemplary embodiment of the invention.

In the ninth exemplary embodiment, the belt device is configured such that the supporting rollers 42, 44 (48, 50) that support the first belt 36 and the second belt 38 are tapered and angled. Further, the first belt 36 and the second belt 38 are skew in the paper transport direction and the angle in the width direction of a paper sheet varies. This exemplary embodiment is effective when it is used for, e.g., a 13.56 MHz type in which parallelism is required.

Figure 15A:
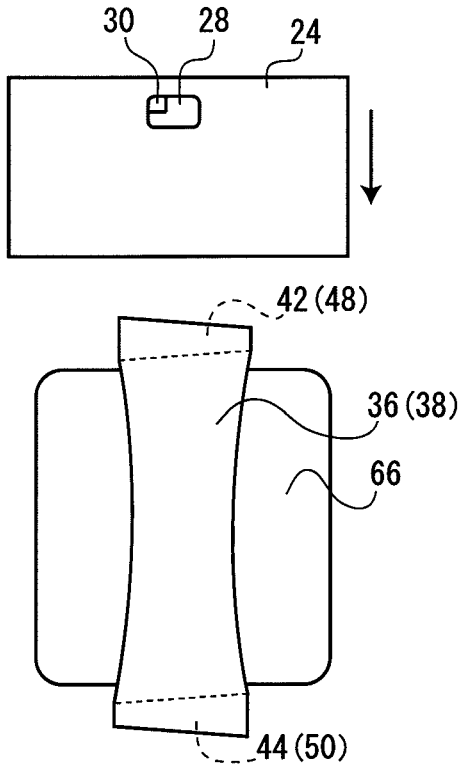
Figure 15B:
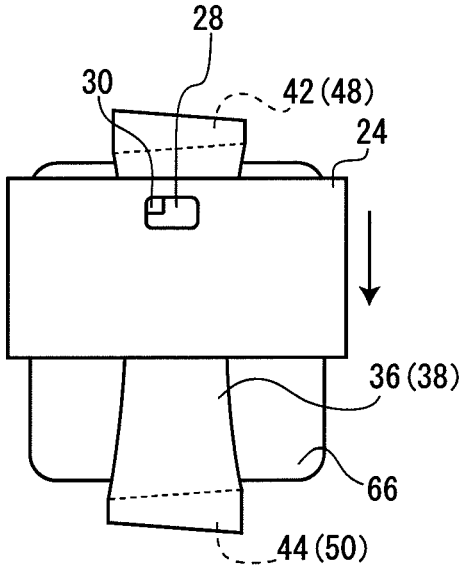

As is illustrated in FIGS. 15A and 15B, in the case where information is read and written from/to a wireless IC element 30 using a large antenna 66 during a period from take-in of the paper sheet 24 until its ejection, the parallelism of the paper sheet 24 relative to the antenna 66 varies as the paper sheet 24 is transported caught between the first belt 36 and the second belt 38. In a position where the paper 24 has become closest to parallel to the antenna 66, information can be read and written from/to the wireless IC element 30. The position where the paper 24 is closest to parallel to the antenna 66 can be detected as the position where the strength of a signal received by the antenna 66 from the wireless IC element 30 is largest.

In the ninth exemplary embodiment, information can be written into the wireless IC element 30 without stopping the paper sheet 24.

Figure 16A:
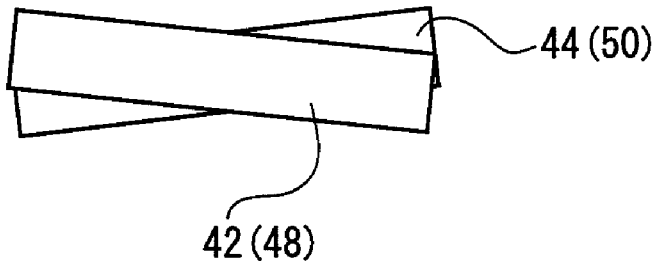
Figure 16B:
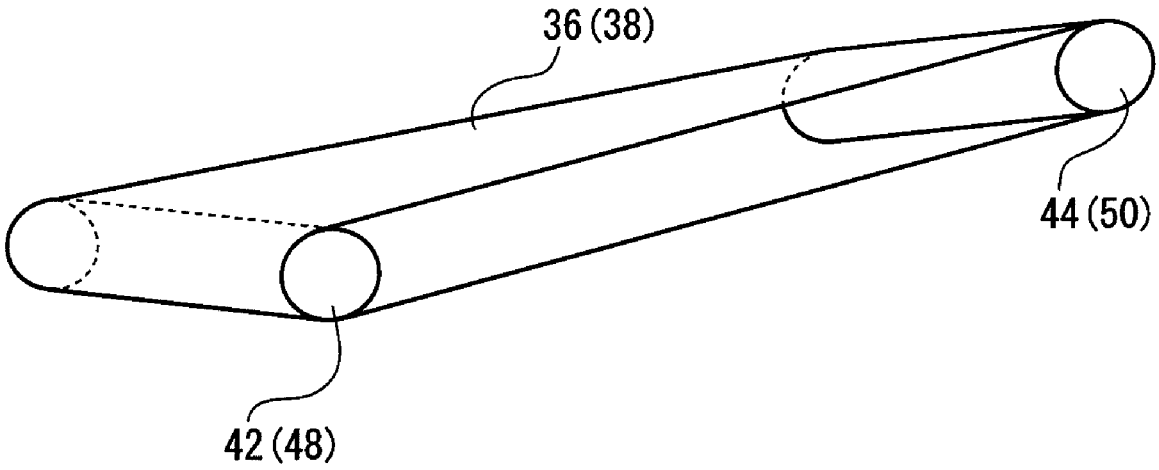

FIGS. 16A and 16B depict a tenth exemplary embodiment of the invention.

The belt device is configured such that the first belt 36 and the second belt 38 are skewed by using tapered supporting rollers 42, 44 (48, 50) in the ninth exemplary embodiment as already described. In the tenth exemplary embodiment, however, the shafts of the supporting rollers 42, 44 (48, 50) are beveled at different angles to skew the first belt 36 and the second belt 38. The angles of the shafts of the supporting rollers 42, 44 (48, 50) may be set at given angles and, may be adjustable so that the angle of a paper sheet 24 with respect to the antenna 66 becomes parallel in a given position.

The present invention may be embodied in other specific forms without departing from its spirit or characteristics. The described exemplary embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed is:

1. An information writing apparatus comprising:

a transport unit that transports a sheet having a wireless integrated circuit (IC) element;

a transmitting and receiving unit that transmits and receives signals to/from the wireless IC element in a sheet transported by the transport unit; and a transport speed controller that controls the transport speed of the transport unit, the transport unit including a first belt made of nonmetal and a second belt made of nonmetal placed facing and contacting the first belt, the sheet being transported, caught between the first belt and the second belt, and wherein the transport speed controller controls the transport unit to make the sheet travel across an area where the sheet faces the transmitting and receiving unit at a lower speed than the transport speed in other areas.

2. An information writing apparatus comprising:

a transport unit that transports a sheet having a wireless integrated circuit (IC) element; and a transmitting and receiving unit that transmits and receives signals to/from the wireless IC element in a sheet transported by the transport unit, the transport unit including a first belt made of nonmetal and a second belt made of nonmetal placed facing and contacting the first belt, the sheet being transported, caught between the first belt and the second belt, wherein the first belt and the second belt have a width that is smaller than the width of a sheet in a direction at right angle to the transport direction of a sheet being transported by the transport unit, and wherein the width of the first belt is smaller than the width of the second belt.

3. An information writing apparatus comprising:

a transport unit that transports a sheet having a wireless integrated circuit (IC) element; and a transmitting and receiving unit that transmits and receives signals to/from the wireless IC element in a sheet transported by the transport unit, the transport unit including a first belt made of nonmetal and a second belt made of nonmetal placed facing and contacting the first belt, the sheet being transported, caught between the first belt and the second belt, wherein the transport unit includes a first group of supporting rollers that support the first belt and a second group of supporting rollers that support the second belt, the first group of supporting rollers including at least a first take-in supporting roller placed in a take-in side of the sheet and a first take-out supporting roller placed in a take-out side of the sheet, the second group of supporting rollers including at least a second take-in supporting roller placed in the take-in side of the sheet and a second take-out supporting roller placed in the take-out side of the sheet, wherein a shaft of the first take-in supporting roller and a shaft of the second take-in supporting roller are in different positions in the sheet transport direction, wherein one of the first take-in supporting roller and the second take-in supporting roller is placed to extend beyond the other in the direction of gravitational force, so that the first belt and the second belt are pressed against each other, and wherein the information writing apparatus further includes a pressing force adjusting unit that adjusts the pressing force of one of the first take-in supporting roller and the second take-in supporting roller.

4. The information writing apparatus according to claim 3, wherein the first belt is placed in an upper position relative to the second belt in the direction of gravitational force and the shaft of the first take-in supporting roller is placed downstream from the shaft of the second take-in supporting roller in the sheet transport direction.

5. The information writing apparatus according to claim 3, wherein the pressing force adjusting unit adjusts the position of the first take-in supporting roller relative to the second take-in supporting roller and vice versa.

6. An information writing apparatus comprising:

a transport unit that transports a sheet having a wireless integrated circuit (IC) element; and a transmitting and receiving unit that transmits and receives signals to/from the wireless IC element in a sheet transported by the transport unit, the transport unit including a first belt made of nonmetal and a second belt made of nonmetal placed facing and contacting the first belt, the sheet being transported, caught between the first belt and the second belt, wherein the transport unit includes a first group of supporting rollers that support the first belt and a second group of supporting rollers that support the second belt, the first group of supporting rollers including at least a first take-in supporting roller placed in a take-in side of the sheet and a first take-out supporting roller placed in a take-out side of the sheet, the second group of supporting rollers including at least a second take-in supporting roller placed in the take-in side of the sheet and a second take-out supporting roller placed in the take-out side of the sheet, wherein the shaft of the first take-out supporting roller and the shaft of the second take-out supporting roller are in different positions in the transport direction, wherein the first take-out supporting roller and the second take-out supporting roller are placed to extend beyond each other in the direction of gravitational force, so that the first belt and the second belt are pressed against each other, and wherein the information writing apparatus further comprises a pressing force adjusting unit that adjusts the pressing force of one of the first take-out supporting roller and the second take-out supporting roller.

7. The information writing apparatus according to claim 6, wherein the first belt is placed in an upper position relative to the second belt in the direction of gravitational force and the shaft of the first take-out supporting roller is placed upstream from the shaft of the second take-out supporting roller in the sheet transport direction.

8. The information writing apparatus according to claim 6, wherein the pressing force adjusting unit adjusts the position of the first take-in supporting roller relative to the second take-in supporting roller and vice versa.

9. An information writing apparatus comprising:

a transport unit that transports a sheet having a wireless integrated circuit (IC) element; and a transmitting and receiving unit that transmits and receives signals to/from the wireless IC element in a sheet transported by the transport unit, the transport unit including a first belt made of nonmetal and a second belt made of nonmetal placed facing and contacting the first belt, the sheet being transported, caught between the first belt and the second belt, and wherein the transport unit further includes a pressing force generating unit that generates a force of pressing the first belt and the second belt against each other.

10. The information writing apparatus according to claim 9, wherein the first belt is placed in an upper position relative to the second belt in the direction of gravitational force, the pressing force generating unit includes a weight, and the pressing force is applied to the first belt and the second belt by gravity.

11. An information writing apparatus comprising:

a transport unit that transports a sheet having a wireless integrated circuit (IC) element; and a transmitting and receiving unit that transmits and receives signals to/from the wireless IC element in a sheet transported by the transport unit, the transport unit including a first belt made of nonmetal and a second belt made of nonmetal placed facing and contacting the first belt, the sheet being transported, caught between the first belt and the second belt, and wherein the first belt is placed in an upper position relative to the second belt in the direction of gravitational force, the transmitting and receiving unit is installed in a space surrounded by the second belt, and the width of the first belt is smaller than the width of the second belt.

12. An information writing apparatus comprising:

a transport unit that transports a sheet having a wireless integrated circuit (IC) element;

a transmitting and receiving unit that transmits and receives signals to/from the wireless IC element in a sheet transported by the transport unit; and a warp preventing component that presents a sheet to be ejected from the transport unit from warping such that both edges of the sheet in a direction at right angle to the transport direction roll back away from the transmitting and receiving unit, the transport unit including a first belt made of nonmetal and a second belt made of nonmetal placed facing and contacting the first belt, the sheet being transported, caught between the first belt and the second belt.

13. The information writing apparatus according to claim 12, wherein the warp preventing component includes auxiliary rollers attached to the shaft of the first take-out supporting roller supporting the first belt.

14. An information writing apparatus comprising:

a transport unit that transports a sheet having a wireless integrated circuit (IC) element; and a transmitting and receiving unit that transmits and receives signals to/from the wireless IC element in a sheet transported by the transport unit, the transport unit including a first belt made of nonmetal and a second belt made of nonmetal placed facing and contacting the first belt, the sheet being transported, caught between the first belt and the second belt, and wherein the information writing apparatus further comprises a length adjusting unit that adjusts a length of a section in which the first belt contacts the second belt.

15. An information writing apparatus comprising:

a transport unit that transports a sheet having a wireless integrated circuit (IC) element; and a transmitting and receiving unit that transmits and receives signals to/from the wireless IC element in a sheet transported by the transport unit, the transport unit including a first belt made of nonmetal and a second belt made of nonmetal placed facing and contacting the first belt, the sheet being transported, caught between the first belt and the second belt, wherein surfaces of the first belt and the second belt are skew.

16. An information writing apparatus comprising:

a transport unit that transports a sheet having a wireless integrated circuit (IC) element; and a transmitting and receiving unit that transmits and receives signals to/from the wireless IC element in a sheet transported by the transport unit, the transport unit including a first belt made of nonmetal and a second belt made of nonmetal placed facing and contacting the first belt, the sheet being transported, caught between the first belt and the second belt, and wherein the sheet having the wireless IC element is a flexible paper sheet.

17. The information writing apparatus according to claim 16, wherein the sheet having the wireless IC element has a plurality of labels each having a wireless IC element.

* * * * *